United States Patent [19]

Da Cruz Garcia

[11] 4,403,816

[45] Sep. 13, 1983

[54] SYSTEM OF VERTICAL FILING OF ARTICLES IN SHEETS AND MEANS EMPLOYED THEREFOR

[76] Inventor: Nelson Da Cruz Garcia, Rua Antonio Braune, 187/233-Rio de Janeiro, BJ, Brazil

[21] Appl. No.: 204,991

[22] Filed: Nov. 7, 1980

[30] Foreign Application Priority Data

Nov. 8, 1979 [BR] Brazil ..... 7258

[51] Int. Cl.[3] ..... A47B 63/00; E05C 19/16

[52] U.S. Cl. ..... 312/184; 312/185; 312/189; 211/46; 248/206 A

[58] Field of Search ..... 312/184, 185, 189; 248/206 A; 211/46

[56] References Cited

U.S. PATENT DOCUMENTS

| | | | |
|---|---|---|---|
| 727,881 | 5/1903 | Beckbissinger | 312/184 |
| 1,217,243 | 2/1917 | Tucker et al. | 312/184 |
| 2,812,067 | 11/1957 | Gussack | 211/46 |
| 2,964,275 | 12/1960 | Atkinson | 248/206 A |
| 3,195,022 | 7/1965 | Staver | 248/206 A |
| 3,292,982 | 12/1966 | Rubissow | 312/184 |
| 3,606,507 | 9/1971 | Williams, Jr. | 312/184 |
| 4,009,784 | 3/1977 | Elias et al. | 312/184 |
| 4,033,013 | 7/1977 | Peterson | 248/206 A |
| 4,105,268 | 8/1978 | Elias et al. | 312/184 |
| 4,261,626 | 4/1981 | Hornbacher | 312/184 |

*Primary Examiner*—Victor N. Sakran

*Attorney, Agent, or Firm*—Browdy and Neimark

[57] ABSTRACT

The invention discloses a new system of filing sheet articles, especially plans, maps, drawings and the like, using magnetic pull to keep them suspended from a folded tape, the two opposed parts thereof containing in their inner faces magnetized plates which hold said sheets. The suspension tapes are hung in a filing cabinet by pins which pass through holes existing in said suspension tapes.

4 Claims, 4 Drawing Figures

SYSTEM OF VERTICAL FILING OF ARTICLES IN SHEETS AND MEANS EMPLOYED THEREFOR

The present invention has as its object a system of vertical filing of articles in sheets, and means employed therefor, said articles to be filed being more specially project plans, drawings, maps and similar articles made in paper sheets.

In the previous art such articles are filed in rolls or, if unrolled, they are filed or stored flat, in a horizontal position. For the vertical filing, owing to the flexibility of the sheets, the filing has involved fixing the sheet to an upper support, which comprised glueing or stapling, or the employment of adhesive tape or other binding means which are inconvenient since they affect the sheet margins, inconvenience the work of the operator besides being the cause of fouling the rolls of heliograph or blueprinting reproduction apparatus, deforming the copies and tearing the plans or drawings to be filed.

Solving these technical problems, the present invention provides a system and means of vertical filing of articles made up by flexible sheets, also doing away with the inconveniences discussed.

The present invention consists of a system and means for filing in vertical suspension through the utilization of magnetic force to hold them, said sheets being easily inserted in the suspending means and also easily withdrawn therefrom without any possibility of damage, inasmuch as no stapling, pasting, union with adhesive tapes or other damaging means are employed.

The invention may be easily understood through the description of a preferred embodiment, which is not restrictive, explained below with reference to the attached drawings, wherein.

Figure 1:
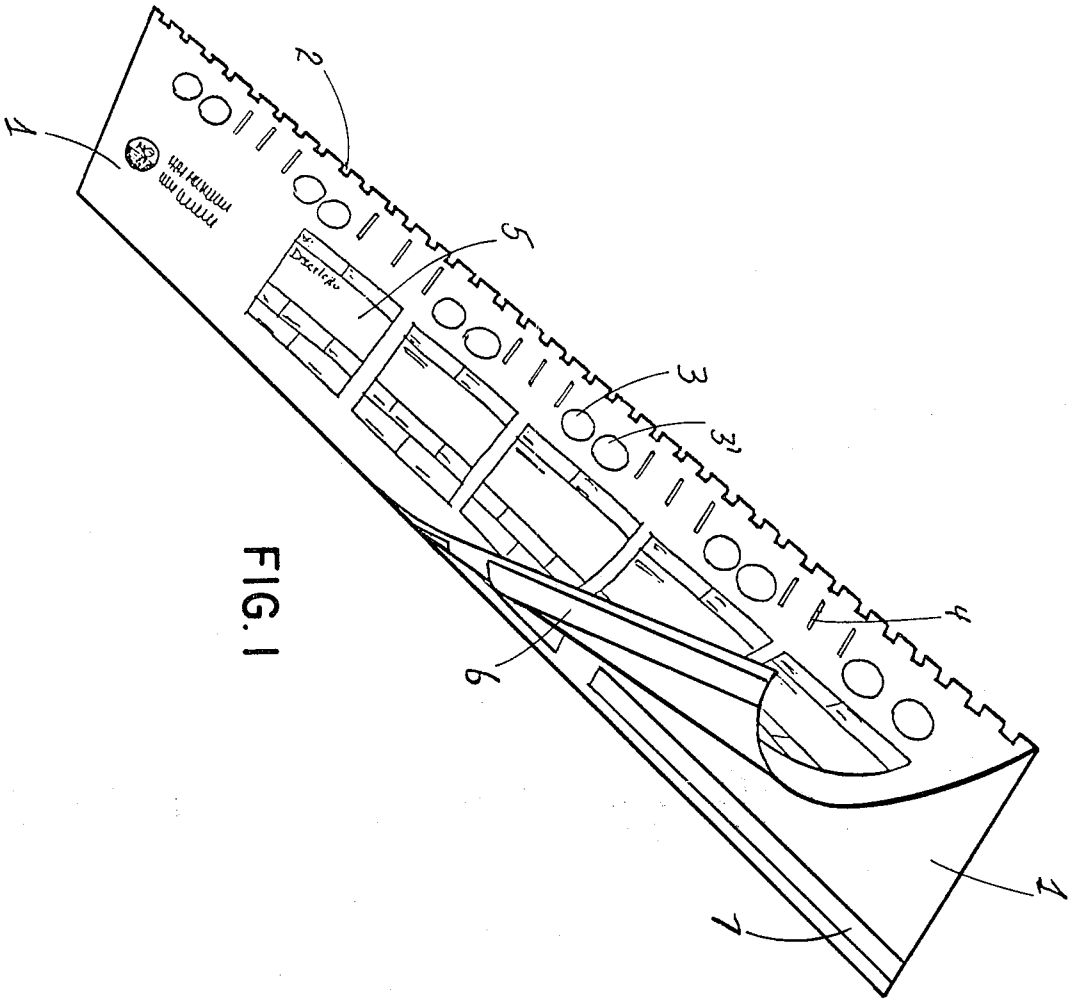
FIG. 1 is a perspective of a suspension means consisting of a folded tape having magnetic retaining means.
Figure 2:
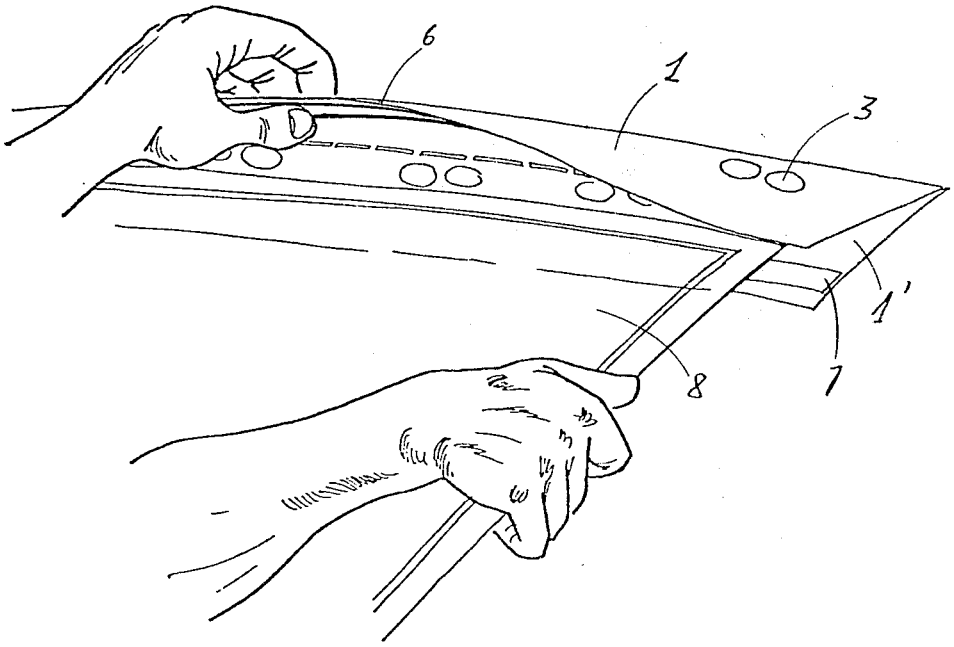
FIG. 2 shows the procedure of fixing the plans or drawings within the fold of the suspension means.
Figure 3:
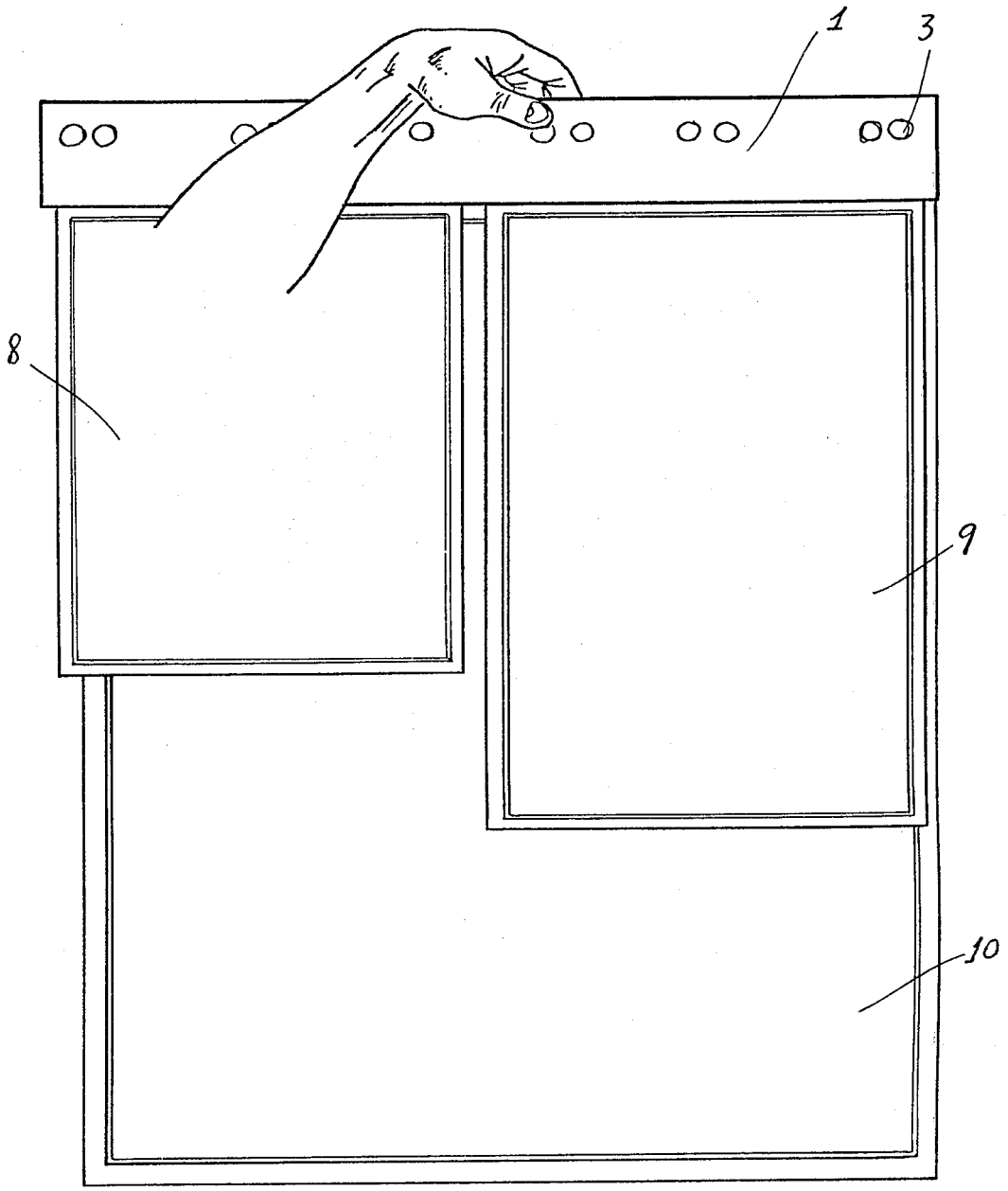
FIG. 3 shows the position of the final filing of plans and drawings already fixed to the magnetized tape, in a vertical position.
Figure 4:
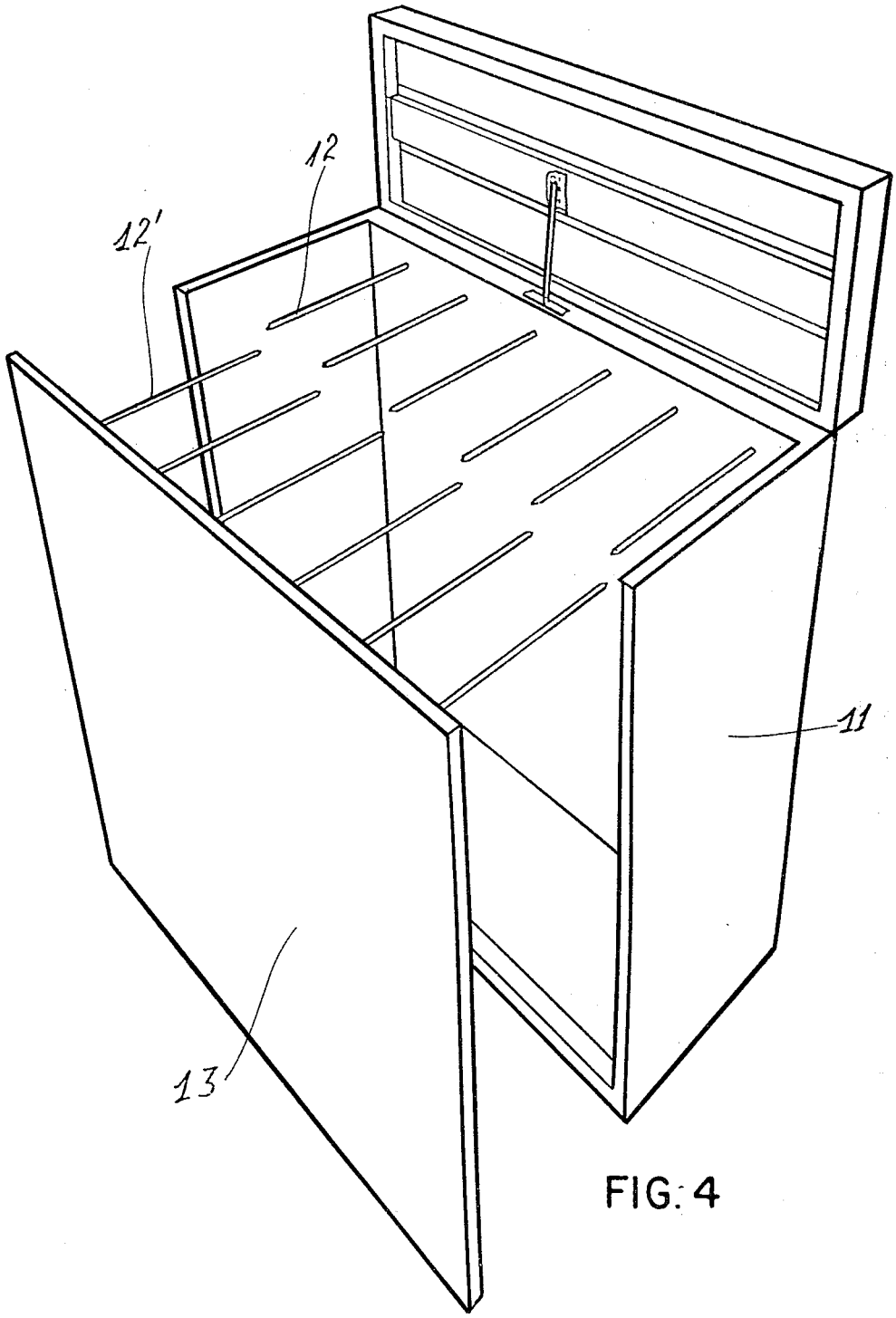
FIG. 4 shows a filing cabinet provided with means to receive the suspension means with the plans and drawings fixed thereto.

In the embodiment shown in the drawings, a suspender is made up of a kraft-paper tape 1, folded along its length, the margin whereof at the fold having slitted lines 2 in order to better accomodate the parts, having pairs of holes 3 and 3' piercing both parts 1 and 1' of the folded sheet, in a position corresponding to the pins of the filing cabinet holding them, and a number of index-holding holes 4 to accomodate acetate indexes which shall be projected above the upper level of the suspenders at the filing. On its front face, tape 1 shall receive the identification prints 5 to transcribe data contained in the legends of the plans or drawings contained therein. On the inner faces of the folded tape 1 there are disposed steel blades 6 fixed to the kraft card on its back face, and tapes of magnetized film or magnetized steel strips 7 fixed to the front face, which are juxtaposed and influenced by magnetism which connects them.

The description allows the inference of the utilization and the practical value of the invention.

The magnetic force of the magnetized zones 6 and 7 existing on the inner faces 1' of the folded kraft-paper tape 1, acts as a retaining force on the plans and drawings 8, 9 and 10, the margins of which are inserted into the fold of said folded tape (1). In order to release it, it will be sufficient to pull away from each other the two folded parts of the paper tape (1—1') until the distance between them overcomes the magnetic pull and the plan or drawing shall be free.

The filing cabinet 11 for keeping plans and drawings 8, 9 and 10 shall be provided with horizontal bars or pins 12 placed at an upper position, balanced from its back, in parallel and corresponding to the positioning of one of the holes of each pair of holes 3. The vertical cover 13 of cabinet 11 shall also be provided with parallel horizontal bars or pins 12', disposed in balance at the upper part of the cabinet, and positioned in correspondence to the second hole 3' of each of the pairs of holes 3 existing in the folded tapes 1.

It is understood that the edges of the plans, maps or drawings, on being inserted into the folded tape 1, do not reach the strip wherein are located holes 3, since both folded parts are previously united by stapling or pasting at this marginal edge, so that the holes 3 and 3' are kept free for the insertion of the horizontal bars or pins in balance 12 and 12'.

When the suspenders 1, containing plans or drawings 8, 9 and 10 therein fixed and hanging therefrom, are kept in the filing cabinet 11, they receive the pins or bars 12, through holes 3. The vertical cover 13 of cabinet 11 is placed so that its pins or bars 12' also go through holes 3' in the suspenders as is evident pins 12' can be made in a fewer number, or even eliminated, since pins 12 are sufficient to hold the filed plans.

I claim:

1. A system for filing sheet articles such as maps, engineering drawings and the like vertically, said system comprising a suspender comprising a pair of blades, said blades being elongated and in juxtapositioned and overlying relation to each other, said pair of blades being formed of a single strip of tape-like material folded in half along its length, and said strip being formed essentially entirely of non-magnetic material, said suspender being positioned with its length generally horizontal in use, means to join said blades together along upper horizontal zones thereof and along their length, hanger means formed in said upper zones of said blades, the remainder of said blades below said upper zones comprising lower zones and article supporting means, said lower zones of said blades being separable from each other over their entire length, magnetic means and means to mount said magnetic means on both of the facing surfaces of said lower zones of said blades, said magnetic means comprising a magnetic tape mounted on the lower zone of one of said blades and a non-magnetized metallic plate mounted on the lower zone of the other of said blades and in facing relation to said magnetic tape over substantially all of said lower zone, said magnetic means being sufficiently magnetically strong so as to tightly grasp an edge portion of an article therebetween and to support the entire weight of said article by said edge portion, means formed in said upper zones to permit said suspender with or without an article supported therein to be hung and filed, said last mentioned suspender filing means comprise holes formed in said upper zones, said holes being defined entirely within said upper zone and being free of any access slits or the like and adapted to cooperate with a plurality of pin means for hanging said suspender vertically, wherein said holes are formed in pairs spaced from each other and arranged on a line parallel to the length of said suspender, whereby in use said lower blade zones are separated from each other by normally overcoming the magnetic attraction of said magnetic means holding said lower zones of said blades together, an edge portion of an article to be filed is placed between the opened up lower blade zones and said lower blades zones are reclosed via said magnetic means to thereby grasp said article edge portion therebetween, and whereby said article edge portion is grasped solely by said magnetic means and is free of any damage as could be caused by glue, staples and the like heretofore used to mount sheet articles on vertical suspenders.

2. The system of claim 1, wherein said upper zones of said blades are joined together by glue or staples.

3. The system of claim 1, wherein said system further comprises a filing cabinet, said cabinet comprising said pin means which separate and then mate with said holes to thereby hang and file said suspender and articles in said cabinet.

4. The system of claim 3, wherein said holes are formed in pairs spaced from each other and arranged on a line parallel to the length of said suspender, and said pin means are mounted half on each of two facing walls of said cabinet and interfit each other and said suspender holes to hang and file said suspender therein.

* * * * *